US006572101B2

(12) United States Patent
Kaya et al.

(10) Patent No.: US 6,572,101 B2
(45) Date of Patent: Jun. 3, 2003

(54) FLEXIBLE JOGGER FOR A SIGNATURE FEEDER

(75) Inventors: Mehmet Oktay Kaya, Lee, NH (US); Heiner Philipp Luxem, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/797,374

(22) Filed: Mar. 1, 2001

(65) Prior Publication Data

US 2002/0121736 A1 Sep. 5, 2002

(51) Int. Cl.[7] ..... B65H 31/00

(52) U.S. Cl. ..... 271/210; 271/223; 271/239; 271/221; 414/789.1; 270/58.27; 270/30.07

(58) Field of Search ..... 271/221, 222, 271/210, 226, 233, 239; 414/788.9, 789.1; 270/58.27, 30.07

(56) References Cited

U.S. PATENT DOCUMENTS

| | | | | |
|---|---|---|---|---|
| 1,554,590 A | * | 9/1925 | McGarvin | 271/222 |
| 4,318,541 A | | 3/1982 | Nagel et al. | 271/222 |
| 4,319,744 A | | 3/1982 | Nagel et al. | 271/222 |
| 4,346,882 A | * | 8/1982 | Pessina et al. | 271/71 |
| 4,616,815 A | * | 10/1986 | Vijuk | 270/45 |
| 4,861,014 A | * | 8/1989 | Martin | 271/198 |
| 5,141,220 A | * | 8/1992 | Ettischer | 271/223 X |
| 5,350,164 A | * | 9/1994 | Coombs | 271/221 X |
| 5,531,437 A | * | 7/1996 | Coombs | 271/293 X |

FOREIGN PATENT DOCUMENTS

| | | |
|---|---|---|
| DE | 938698 | 2/1956 |
| JP | 59182155 | 10/1984 |

* cited by examiner

*Primary Examiner*—Frank E. Werner
(74) *Attorney, Agent, or Firm*—Davidson, Davidson & Kappel, LLC

(57) ABSTRACT

A jogger for a signature feeder includes a back stop disposed at a first side of a hopper of the feeder and a flexible jogging element disposed at a second side of the hopper opposite the first side. As a stack of signatures is formed in the hopper, the flexible jogging element is oscillated in a lateral direction so as to periodically bend the flexible jogging element against the stack of the signatures and form a pushing zone and a vibrating zone in the hopper. The vibrating zone is below the pushing zone, and the vertical lengths of the pushing and vibrating zones are a function of the height of the stack of signatures. The signatures in the pushing zone are urged against the back stop by the flexible jogging element so as to register the signatures as the stack is formed, and the signatures in the vibrating zone are vibrated by the flexible jogging element so as to improve the registration of the signatures in the stack. The jogging action adjusts automatically to the height of the stack and the characteristics of the signatures.

30 Claims, 2 Drawing Sheets

FLEXIBLE JOGGER FOR A SIGNATURE FEEDER

BACKGROUND OF THE INVENTION

1. Field of the Invention

The present invention relates generally to printing presses and more particularly to a flexible jogger for a signature feeder in a printing press.

2. Background Information

During printing press operations printed signatures are feed to downstream processes. Signature feeders are used to collect and align (register) the signatures for controlled feeding to a subsequent operation. Mechanical jogging devices have been used for loading signatures into a hopper, or feeder pocket, of a signature feeder to "jog," or move the signatures into alignment, as they are come into the hopper, thereby improving signature registration. Existing mechanical joggers push incoming signatures against a backstop plate in a hopper, thereby registering the signatures as they form a stack in the hopper.

Existing mechanical joggers do not adjust to signature stack height or to signature characteristics.

BRIEF SUMMARY OF THE INVENTION

An object of the present invention is to provide a signature feeder having a jogger which automatically adjusts to signature stack height and to signature characteristics so as to improve signature registration.

The present invention provides a jogger for a signature feeder having a hopper for receiving signatures at an upper end of the hopper and forming a stack of the signatures in a vertical direction starting at a lower end of the hopper, the jogger comprising: a back stop disposed at a first side of the hopper; and a flexible jogging element disposed at a second side of the hopper opposite the first side, the flexible jogging element being oscillated in a direction lateral to the vertical direction so as to periodically bend the flexible jogging element against the stack of the signatures and form a pushing zone and a vibrating zone below the pushing zone in the hopper, the signatures in the pushing zone being urged against the back stop by the flexible jogging element so as to register the signatures as the stack is formed, the signatures in the vibrating zone being vibrated by the flexible jogging element so as to improve the registration of the signatures in the stack.

The respective vertical length of each of the pushing zone and the vibrating zone is a function of the height of the stack The flexible jogging element bends toward the stack of signatures so as to assume a curved shape, the curved shape being a function of at least one of the height of the stack of signatures and a characteristic of the signatures, such as a modulus of a material of the signatures, a stiffness of the signatures, a size of the signatures and a shape of the signatures.

The curved shape that the flexible jogging element assumes may be parabolic. The flexible jogging element may be non-translatably and non-rotatably fixed at a lower end of the hopper. The flexible jogging element may be pivotably fixed at a lower end of the hopper.

The flexible jogging element may be oscillated at a portion of the element disposed at an upper end of the hopper.

The flexible jogging element maybe a thin plate. The flexible jogging element may include a plurality of adjacent fingers.

The flexible jogging element may be made of metal or of a plastic material.

The flexible jogging element is oscillated using at least one of a cam and a crank arm.

The back stop may be rigid or flexible, and may be curved. The back stop may have a motion imparted to it.

The present invention also provides a method for jogging signatures in a signature feeder, the method comprising: receiving the signatures at an upper end of a hopper of the signature feeder and forming a stack of the signatures in a vertical direction starting at a lower end of the hopper; and oscillating a flexible jogging element in a direction lateral to the vertical direction so as to periodically bend the flexible jogging element against the stack of the signatures and form a pushing zone and a vibrating zone below the pushing zone in the hopper, the flexible jogging element being disposed at a first side of the hopper, the signatures in the pushing zone being urged by the flexible jogging element against a back stop disposed at a second side of the hopper opposite the first side so as to register the signatures as the stack is formed, the signatures in the vibrating zone being vibrated by the flexible jogging element so as to improve the register of the signatures in the stack.

BRIEF DESCRIPTION OF THE DRAWINGS

The present invention is elaborated upon below with reference to the drawings, in which.

DETAILED DESCRIPTION

Figure 1:
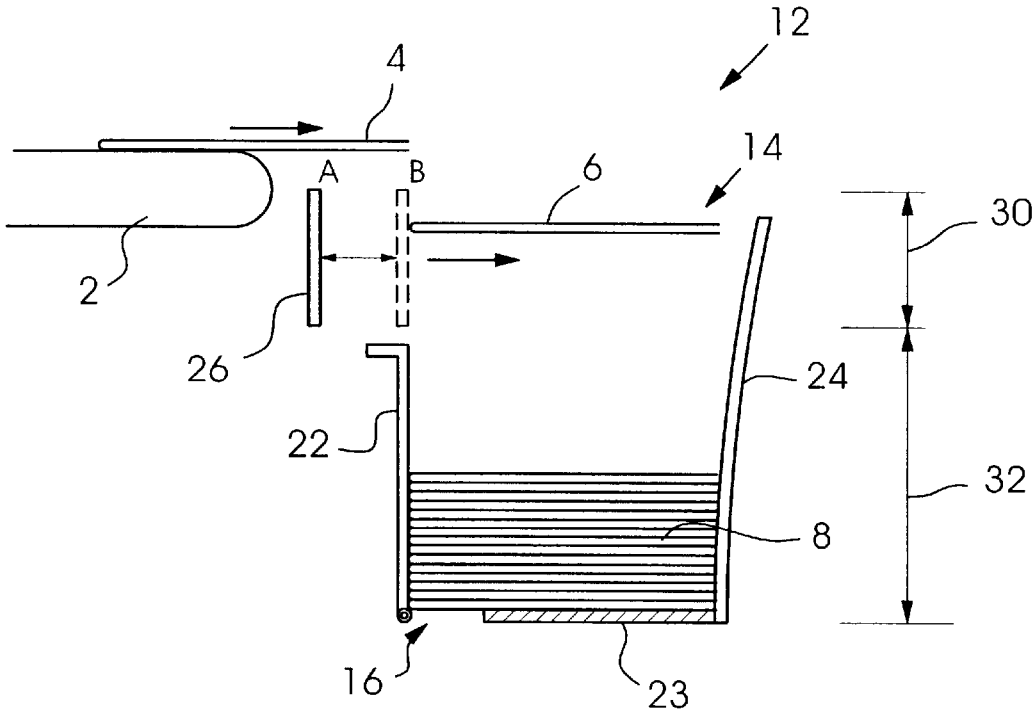
FIG. 1 shows a schematic diagram of a signature feeder having a prior art jogger with a rigid translating jogger element.

FIG. 1 shows a schematic diagram of a signature feeder 12 having a prior art jogger 14. Signature feeder 12 includes hopper 16 having a front plate 22 and a bottom formed by signature table 23. Jogger 14 includes rigid translating jogging element 26 and backstop 24. Rigid translating jogging element 26 is oscillated laterally between positions A and B as indicated in FIG. 1. In synchronous fashion with the oscillation of rigid translating jogging element 26 signatures 4 are each delivered by conveyor 2 into hopper 16 as incoming signature 6. Each incoming signature 6 is pushed toward backstop 24 by the oscillating action of rigid translating jogging element 26 in pushing zone 30 so as to register each signature 6 as it joins signature stack 8, formed in hopper 16. The signatures in signature stack 8 undergo no further registering action in static zone 32.

Figure 2:
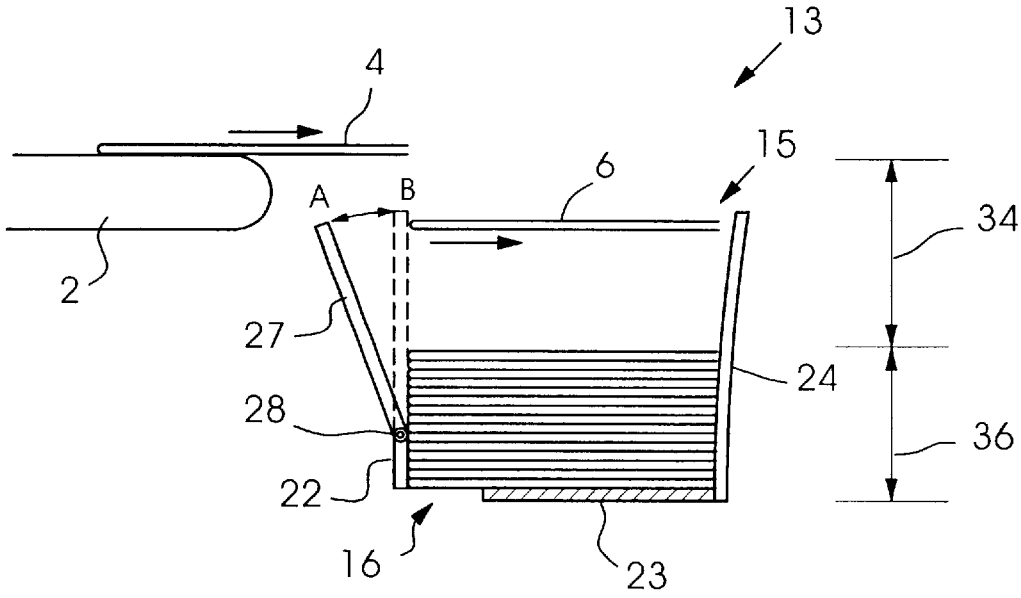
FIG. 2 shows a schematic diagram of a signature feeder having a prior art jogger with a rigid pivoting jogger element.

FIG. 2 shows a schematic diagram of a signature feeder 13 having a prior art jogger 15. Signature feeder 13 includes hopper 16 having a front plate 22 and a bottom formed by signature table 23. Jogger 15 includes rigid pivoting jogging element 27 and backstop 24. Rigid pivoting jogging element 27 pivots about pivot 28 in an oscillating fashion so as to oscillate between positions A and B as indicated in FIG. 2. In synchronous fashion with the oscillation of rigid pivoting jogging element 27 signatures 4 are each delivered by conveyor 2 into hopper 16 as incoming signature 6. Each incoming signature 6 is pushed toward backstop 24 by the oscillating action of rigid pivoting jogging element 27 in pushing zone 30 so as to register each signature 6 as it joins signature stack 8, formed in hopper. As with the jogger shown in FIG. 1, the signatures in signature stack 8 undergo no further registering action in static zone 32.

Figure 3:
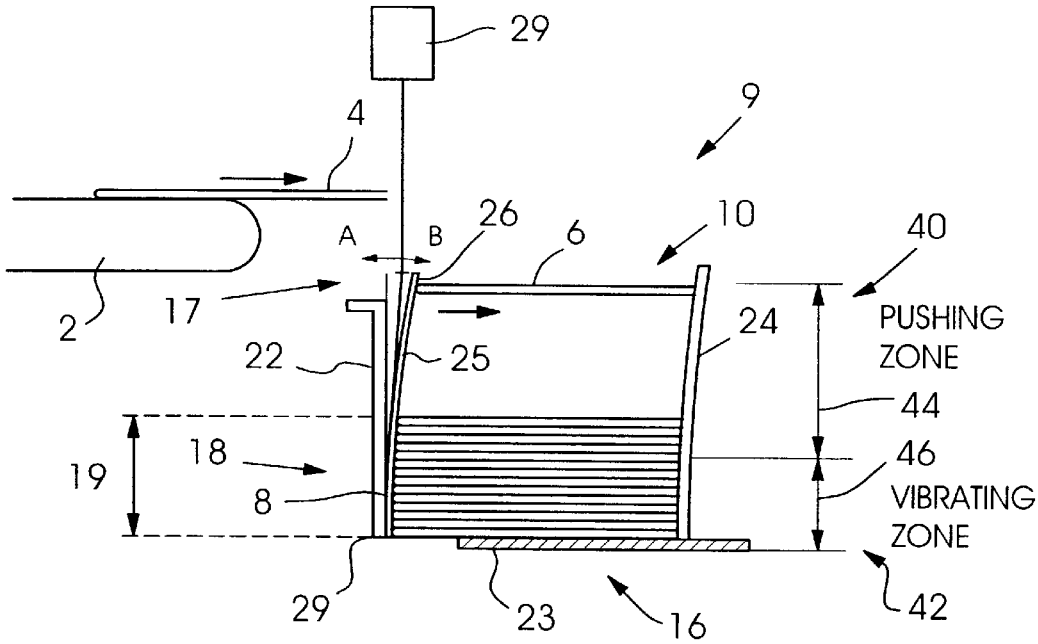
FIG. 3 shows a schematic diagram of a signature feeder having a flexible jogger according to an embodiment of the present invention.

FIG. 3 shows a schematic diagram of a signature feeder 9 having a flexible jogger 10 according to an embodiment of the present invention. Signature feeder 9 includes hopper 16 having upper end 17 and lower end 18, as well as front plate 22 and bottom 23 formed by a signature table, for example. Jogger 10 includes flexible jogging element 25 and backstop 24. Flexible jogging element 25 is fixedly attached to front plate 22 at bend point 29 in lower end 17 of hopper 16. Alternatively, flexible jogging element 25 may be pivotably attached at bend point 29. In other embodiments of the present invention flexible jogging element 25 may be attached to any other suitable structure.

Flexible jogging element 25 may be a thin plate of a metal material. Alternatively, flexible jogging element 25 may be a thin plate of a plastic, or other suitable bendable resilient material. In other embodiments of the present invention flexible jogging element 25 may be a plurality of elongated finger-like members arranged adjacent to each other. Back stop 24 may be a rigid or flexible planar or curved element, for example. In other embodiments of the present invention backstop 24 may be articulated and/or be have a motion, such as an oscillating motion, imparted to it.

Flexible jogging element 25 is oscillated, or reciprocated, in a lateral direction by an oscillating device 29 so as to oscillate between positions A and B as indicated in FIG. 3. The oscillating device preferably imparts the oscillation to flexible jogging element 25 at upper portion 26 of the jogging element in upper end 18 of hopper 16. The oscillation device may be any suitable mechanical or other device for imparting an oscillating, or reciprocating, motion to flexible jogging element 25, such as any of a variety of cam, crank arm, etc., devices, the construction of which would be known to one of skill in the art.

In synchronous fashion with the oscillation of flexible jogging element 25, signatures 4 are each delivered by conveyor 2 into hopper 16 as incoming signature 6. It should be noted that the term "signatures" in reference to the present invention is intended to encompass any type of individual sheets of material, such as, for example, paper. Each incoming signature 6 is pushed toward backstop 24 by the oscillating action of flexible jogging element 25 in pushing zone 40 so as to register signature 6 as it joins signature stack 8 formed in hopper 16 in vibrating zone 42 and extending into pushing zone 40. At the same time, the signatures already registered in signature stack 8 and lying in vibrating zone 42 are gently vibrated by the oscillating motion of flexible jogging element 25 so as to improve the registration of signature stack 8. As flexible jogging element 25 in its oscillating motion moves to incoming signature 6 to push the signature toward back stop 24, it bends against signature stack 8, assuming a curved, for example a parabolic, shape. The specific characteristics of the curved shape that flexible jogging element 25 assumes is dependent on height 19 of stack 8.

Figure 4:
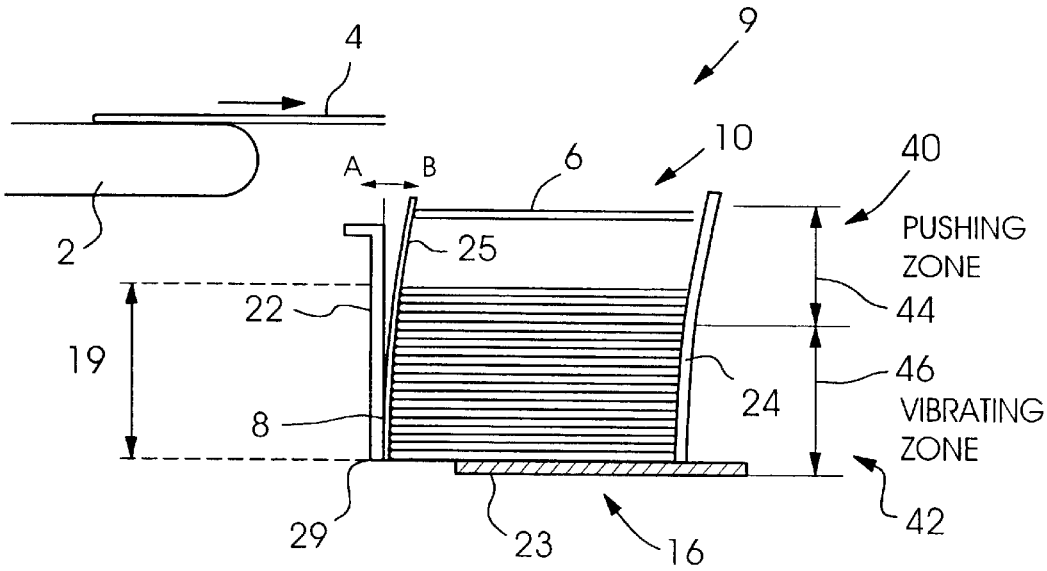
FIG. 4 shows a schematic diagram of the signature feeder according to FIG. 3 with a higher stack of signatures.

Pushing zone 40 and vibrating zone 42 are formed by the oscillating motion of flexible jogging element 25 as it encounters and bends against signature stack 8. Vertical lengths 44 and 46 of pushing zone 40 and vibrating zone 42, respectively, are variable and are a function of height 19 of signature stack 8. FIG. 4 shows signature feeder 9 with a larger stack height 19 in hopper 16. The vertical length 44 of pushing zone 40 is reduced, while the vertical length 46 of vibrating zone 42 is correspondingly increased. As the respective vertical lengths of pushing zone 40 and vibrating zone 42 change according to the height of signature stack 8, the jogging, or pushing and registering, action of flexible jogging element 25 is automatically adjusted at the same time due to the flexibility and arrangement of element. The flexibility and arrangement of flexible jogging element 25 likewise enables an automatic adjustment of its jogging action according to the characteristics of the signatures. The relative amount of pushing and vibrating applied to the signatures varies with the modulus of the signature material, the stiffness of the signatures, the size and shape of the signatures, etc., automatically. The automatic adjustment in jogging action results in improved registration of the signatures.

Other variations and embodiments of the present invention, beyond those described herein, are possible. The present invention is intended to be limited only by the scope of the appended claims.

What is claimed is:

1. A jogger for a signature feeder having a hopper for receiving signatures at an upper end of the hopper and forming a stack of the signatures in a vertical direction starting at a lower end of the hopper, the jogger comprising:

a back stop disposed at a first side of the hopper;

a flexible jogging element disposed at a second side of the hopper opposite the first side; and an oscillating device in operative connection with the flexible jogging element configured to oscillate the flexible jogging element in a direction lateral to the vertical direction so as to periodically bend the flexible jogging element against the stack of the signatures and form a pushing zone and a vibrating zone below the pushing zone in the hopper, the signatures in the pushing zone being urged against the back stop by the flexible jogging element during oscillation so as to register the signatures as the stack is formed, the signatures in the vibrating zone being vibrated by the flexible jogging element during oscillation so as to improve the registration of the signatures in the stack.

2. The signature feeder as recited in claim 1 wherein a respective vertical length of each of the pushing zone and the vibrating zone is a function of a height of the stack.

3. The signature feeder as recited in claim 1 wherein the flexible jogging element bends toward the stack of signatures so as to assume a curved shape, the curved shape being a function of at least one attribute selected from the group consisting of a height of the stack of signatures and a characteristic of the signatures.

4. The signature feeder as recited in claim 3 wherein the characteristic of the signatures is selected from the group consisting of a modulus of a material of the signatures, a stiffness of the signatures, a size of the signatures, and a shape of the signatures.

5. The signature feeder as recited in claim 3 wherein the curved shape is parabolic.

6. The signature feeder as recited in claim 1 wherein the flexible jogging element is non-translatably and non-rotatably fixed at a lower end of the hopper.

7. The signature feeder as recited in claim 1 wherein the flexible jogging element is pivotably fixed at the lower end of the hopper.

8. The signature feeder as recited in claim 1 wherein the flexible jogging element is oscillated at a portion of the element disposed at an upper end of the hopper.

9. The signature feeder as recited in claim 1 wherein the flexible jogging element is a thin plate.

10. The signature feeder as recited in claim 1 wherein the flexible jogging element includes a plurality of adjacent fingers.

11. The signature feeder as recited in claim 1 wherein the flexible jogging element is made of metal.

12. The signature feeder as recited in claim 1 wherein the flexible jogging element is made of a plastic material.

13. The signature feeder as recited in claim 1 wherein the oscillating device includes at least one of a cam and a crank arm.

14. The signature feeder as recited in claim 1 wherein the back stop is rigid.

15. The signature feeder as recited in claim 1 wherein the back stop is flexible.

16. The signature feeder as recited in claim 1 wherein the back stop is curved.

17. The signature feeder as recited in claim 1 wherein the back stop has an imparted motion.

18. A method for jogging signatures in a signature feeder, the method comprising:

receiving the signatures at an upper end of a hopper of the signature feeder and forming a stack of the signatures in a vertical direction starting at a lower end of the hopper; and oscillating a flexible jogging element in a direction lateral to the vertical direction so as to periodically bend the flexible jogging element against the stack of the signatures and form a pushing zone and a vibrating zone below the pushing zone in the hopper, the flexible jogging element being disposed at a first side of the hopper, wherein the oscillating of the flexible jogging element urges the signatures in the pushing zone against a back stop disposed at a second side of the hopper opposite the first side so as to register the signatures as the stack is formed and vibrates the signatures in the vibrating zone so as to improve the registration of the signatures in the stack.

19. The method as recited in claim 18 wherein a respective height of each of the pushing zone and the vibrating zone is a function of a height of the stack of signatures.

20. The method as recited in claim 18 wherein the oscillating is performed so that the flexible jogging assumes a curved shape, the curved shape being a function of at least one attribute selected from the group consisting of a height of the stack of signatures and a characteristic of the signatures.

21. The method as recited in claim 20 wherein the characteristic of the signatures is selected from the group consisting of a modulus of a material of the signatures, a stiffness of the signatures, a size of the signatures and a shape of the signatures.

22. The method as recited in claim 20 wherein the curved shape is parabolic.

23. The method as recited in claim 18 wherein the flexible jogging element is non-translatably and non-rotatably fixed at a lower end of the hopper.

24. The method as recited in claim 18 wherein the flexible jogging element is pivotably fixed at a lower end of the hopper.

25. The method as recited in claim 18 wherein the flexible jogging element is oscillated at a portion of the element disposed at an upper end of the hopper.

26. The method as recited in claim 18 wherein the flexible jogging element is a thin plate.

27. The method as recited in claim 18 wherein the flexible jogging element includes a plurality of generally vertically oriented fingers disposed in a common plane.

28. The method as recited in claim 18 wherein the flexible jogging element is made of at least one of a metal and a plastic material.

29. The method as recited in claim 18 wherein the oscillating is performed using at least one of a cam and a crank arm.

30. The method as recited in claim 18 wherein the back stop is curved.

* * * * *